United States Patent [19]

Del Rosso

[11] 4,025,382

[45] May 24, 1977

[54] LABEL APPLICATOR

[75] Inventor: Victor Del Rosso, Ithaca, N.Y.

[73] Assignee: Hi-Speed Checkweigher Co., Inc., Ithaca, N.Y.

[22] Filed: July 14, 1975

[21] Appl. No.: 595,741

[52] U.S. Cl. ..... 156/497; 156/521; 156/542; 156/572; 156/580; 156/DIG. 31; 156/DIG. 42

[51] Int. Cl.[2] ..... B65C 9/14; B65C 9/36

[58] Field of Search ..... 156/497, 541, 542, 572, 156/DIG. 33, DIG. 42, 493, 580, 584, 384, 521, 230, 571, 519, DIG. 31

[56] References Cited

UNITED STATES PATENTS

| | | | |
|---|---|---|---|
| 2,681,743 | 6/1954 | Phin et al. | 156/571 |
| 2,684,547 | 7/1954 | Richter et al. | 156/541 |
| 2,712,393 | 7/1955 | Brown | 156/572 |
| 3,232,815 | 2/1966 | Klopfenstein et al. | 156/571 |
| 3,329,550 | 7/1967 | Kucheck | 156/497 |
| 3,616,016 | 10/1971 | Dinter | 156/542 X |
| 3,625,801 | 12/1971 | Reed et al. | 156/542 |
| 3,682,743 | 8/1972 | Cleary et al. | 156/584 X |
| 3,729,362 | 4/1973 | French et al. | 156/542 |
| 3,794,543 | 2/1974 | Bonomi | 156/572 X |

*Primary Examiner*—Douglas J. Drummond
*Assistant Examiner*—M. G. Wityshyn
*Attorney, Agent, or Firm*—Bean, Kauffman & Bean

[57] ABSTRACT

An apparatus for applying a label to an article while the article is being transported along a path of travel by a conveyor, including a vertically movable applicator foot operable to pick up a label from a source and apply such label to the surface of an article and a vertically movable compressor foot operable to engage the applied label to cause it to conform to the contour of the article surface. The applicator foot and compressor foot are independently supported for conjunctive movements with the article in the direction of conveyor travel, while operably engaged therewith.

12 Claims, 9 Drawing Figures

LABEL APPLICATOR

SUMMARY OF THE INVENTION

The present invention is directed towards an apparatus for applying a label to an article, as the article is being transported along a path of travel by a conveyor.

More particularly, the present invention is directed towards an improved label applicator particularly adpated for use in an article weighing and labeling system of the type disclosed in commonly assigned U.S. patent application Ser. No. 536,301, filed Dec. 26, 1974, now U.S. Pat. No. 3,955,665.

More specifically, the label applicator of the present invention includes a vertically movable applicator foot operable to pick up a label from a source and apply such label to the surface of an article and a vertically movable compressor foot operable to engage the applied label such as to cause it to conform to the contour of the article. The applicator foot and compressor foot are independently supported for conjunctive movements with the article in the direction of conveyor travel, while operably engaged with the article, in order to avoid damage to the label and/or the article and/or misalignment of the label relative to the article.

DRAWINGS

The nature and mode of operation of the present invention will now be more fully described in the following detailed description taken with the accompanying drawings wherein.

DETAILED DESCRIPTION

Figure 1:
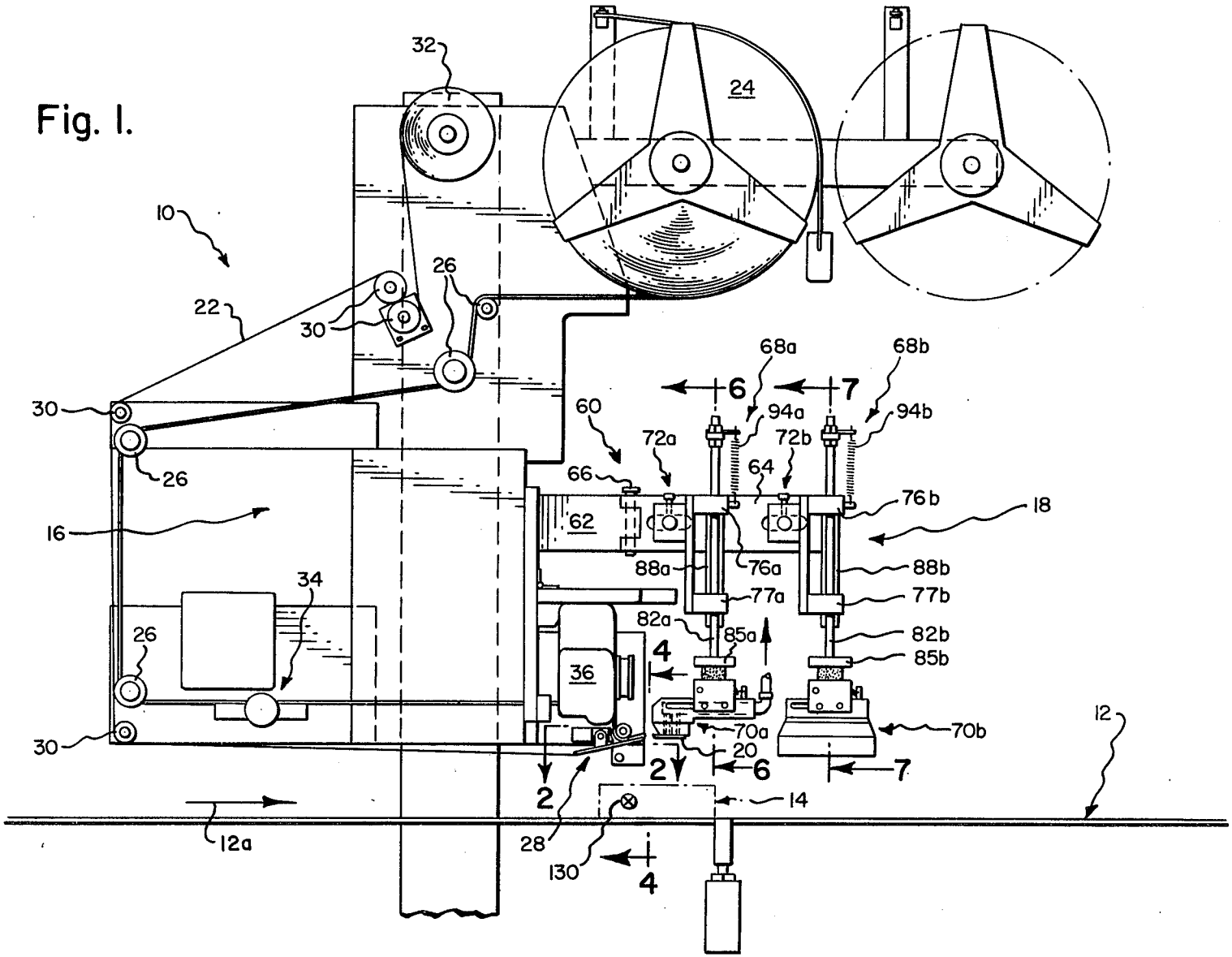
FIG. 1 is an elevational view showing a label applicator formed in accordance with the present invention.
Figure 2:
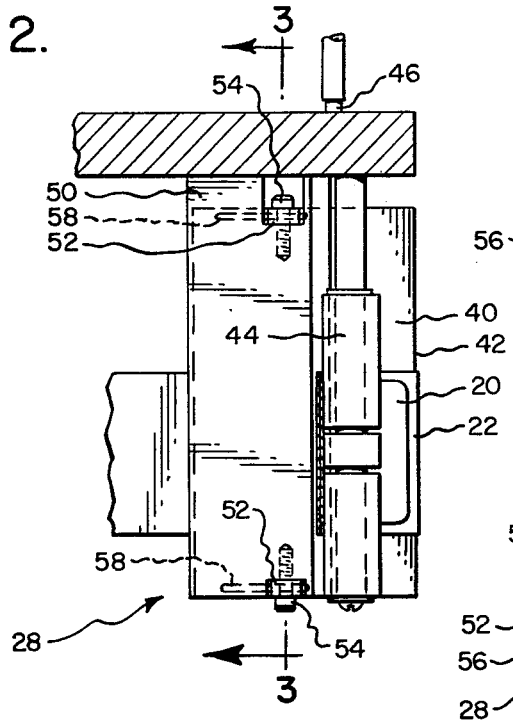
FIG. 2 is a sectional view taken generally along the line 2—2 in FIG. 1.
Figure 4:
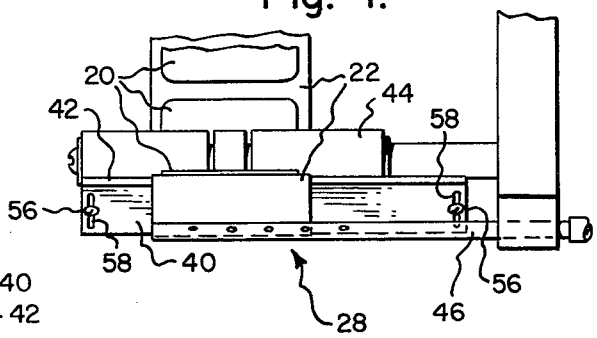
FIG. 4 is a sectional view taken generally along the line 4—4 in FIG. 1.
Figure 3:
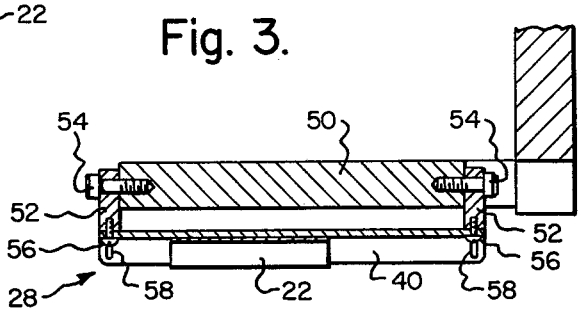
FIG. 3 is a sectional view taken generally along the line 3—3 of FIG. 2.

Reference is now made particularly to FIG. 1, wherein 10 is employed to generally designate a labeling station suitable for use in an article weighing and labeling system of the type disclosed in commonly assigned patent application Ser. No. 536,301, filed Dec. 26, 1974, now U.S. Pat. No. 3,955,665, which would additionally include an article weighing station, not shown, and a continuously driven endless conveyor 12 serving to transport articles 14 successively through the weighing and labeling stations in the direction indicated by arrows 12*a* in FIGS. 1 and 5. The term "article" is used generically herein to include an individual article as well as a package including one or more articles. Further, while for purposes of simplicity, articles 14 are depicted in the drawings as being of box-like configuration and as having planar upper or label receiving surfaces, it will be understood that the invention is particularly adapted for use in applying labels to articles having contoured or irregular upper surfaces, such as would be defined by wrapping a clear plastic protective wrapper about a "tray" filled with a "mound" of hamburger or a plurality of chicken parts.

Labeling station 10 generally includes a label supply and printer mechanism 16, which may be essentially conventional in construction, and a label applicator mechanism 18, which is formed in accordance with the present invention. Labels to be applied to articles 14 are individually designated as 20 in FIGS. 1, 2, 4 and 5, and are preferably of the type having a pressure sensitive adhesive coated rear surface permitting them to be individually "peeled" from a carrier tape 22 and then adhered directly to the upper surface of article 14. To this end, mechanism 16 would preferably include suitable means for mounting a supply roll 24 from which carrier tape 22 bearing labels 20 is withdrawn and passed via guide or transport rollers 26 to a label separator or peeling device 28; carrier tape 22 then being passed from device 28 over guide or transport rollers 30 to a driven takeup reel 32. Mechanism 16 would also preferably include a first or constant data printer 34, which is adapted for instance to print the name of the articles being weighed on all of the labels and a second or variable printer 36, which is adapted to print individual article information, such as net weight, price per pound and total weight on the successively presented labels. Of course, transport of articles through the weighing and labeling stations is suitably controlled to insure that the labels are applied to the articles to which their printed information pertains.

Figure 5:
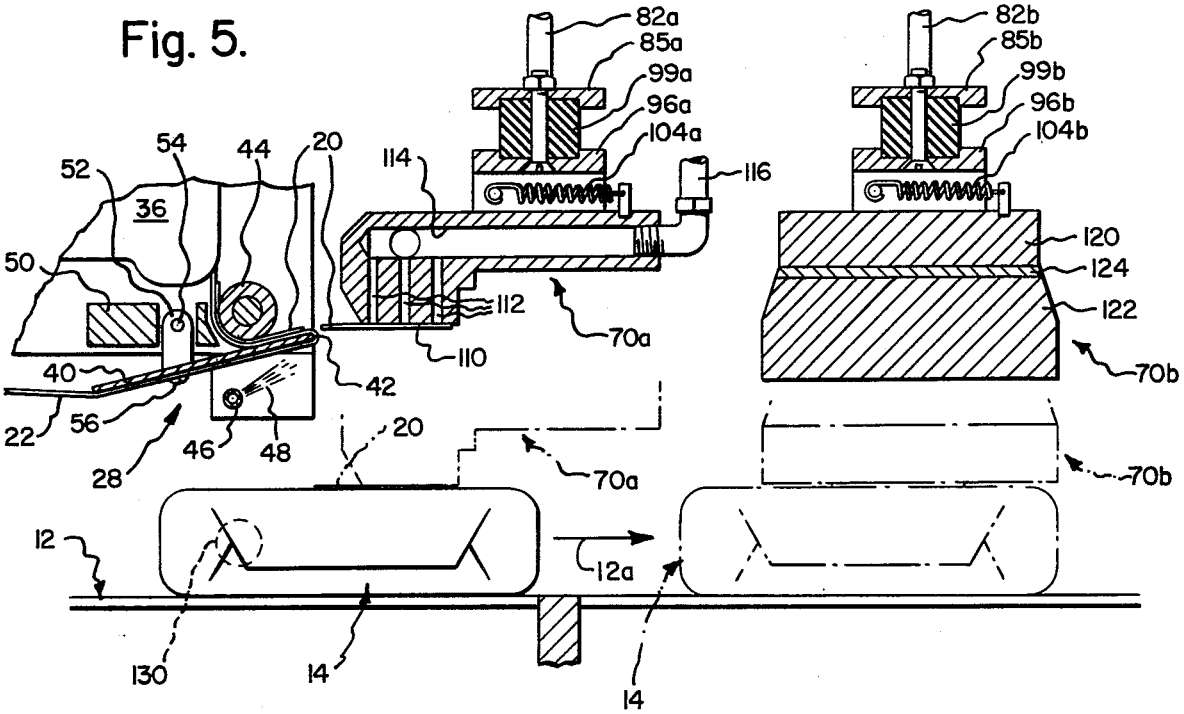
FIG. 5 is an enlarged sectional view taken vertically through the label applicator and compressor feet.

A preferred form of label separator device 28 is shown in FIGS. 2–5 as including a label peeler plate 40, which defines a peeling edge 42 having a relatively small radius of curvature; a guide roller 44 for guiding carrier tape 22 for travel over peeling edge 42; and an air tube 46 for creating label supporting air jets 48. Many commercially available labels of the carrier tape mounted variety have been found to readily separate from their carrier tapes when the latter is forced to abruptly change direction, as for instance by being forced to pass about an edge having a small radius of curvature approximating that of a rounded "knife edge," while the label is unconstrained except for its temporary bond with the carrier tape. This is due in part to the face that the adhesive bond between the labels and carrier type is intentionally a weak bond and due in part to the fact that commercially available labels are normally formed of a material which is less flexible than the material from which the carrier tape is formed. Thus, it will be apparent from viewing FIG. 5 that the leading edge of a printed label tends to separate from the carrier tape immediately upon the turning of the latter downwardly about peeling edge 42 and thereafter tends to proceed in a horizontal direction as succeeding portions of the label are peeled from the carriage tape. However, it is desirable to direct air jets 48 upwardly towards leading edge 42 and in the direction of conveyor travel, as indicated in FIG. 5, in order to insure proper initial separation of the leading edge of the label from the carrier tape and thereafter insure that the label is supported in an essentially horizontally disposed position during the following label separation and pickup operation.

Plate 40 is preferably suspended from a bracket 50 by a pair of hanger members 52 for vertical pivotal adjustments about essentially horizontally disposed pivot axis, which is defined by a pair of adjustable locking bolts 54 and arranged to extend essentially transversely of the path of conveyor travel. Plate 40 may also be adjustably fixed to hanger members 52 for displacements in the direction of conveyor travel by means of a pair of screw devices 56 adjustably received within plate slots 58. Adjustments of plate 40 relative to hanger members 52 serve to accommodate for varying lengths of labels in the direction of carrier tape travel, so as to insure proper pickup of such labels by applicator mechanism 18 in the manner to now be described.

Applicator mechanism 18 generally comprises a bracket mounting assembly 60 including fixed and movable hinge parts 62 and 64, which are joined for relative horizontal swinging movements about a vertically disposed axis by a hinge pin 66; and first and second supporting assemblies 68*a* and 68*b*, which serve to movably suspend a label applicator foot 70*a* and a label compressor foot 70*b*, respectively, from movable hinge part 64. As will be apparent, movable hinge part 64 is normally arranged to position feet 70*a* and 70*b* in vertical alignment with conveyor 12, but is swingable about the axis of hinge pin 66 to afford unobstructed access to the conveyor. Also, the first and second supporting assemblies 68*a* and 68*b* are preferably fixed to movable hinge part 64 for adjustments lengthwise thereof, as by suitable adjustment devices 72*a* and 72*b*, whereby to adjust positioning of feet 70*a* and 70*b* relative to each other and separator device 28, as required to accommmodate for variations in package size and/or spacing in the direction of conveyor travel.

More specifically, first and second supporting assemblies 68*a* and 68*b* are identical in construction from the standpoint that they include stationary mounting brackets 74*a* and 74*b*, which are fixed by adjustment devices 72*a* and 72*b* to movable hinge part 64 and define upper and lower bearings 76*a*, 77*a* and 76*b*, 77*b;* slide assemblies 80*a* and 80*b*, which include pairs of parallel slide rods 82*a* and 82*b*, which are fixedly interconnected adjacent their upper and lower ends by brackets 84*a*, 85*a* and 84*b*, 85*b* and are slidably supported for vertical reciprocating movements intermediate such ends by bearings 76*a*, 77*a* and 76*b*, 77*b;* operators 88*a* and 88*b*, which are preferably in the form of pneumatic cylinders rigidly fixed to mounting brackets 74*a* and 74*b* and provided with extensible piston rods 90*a* and 90*b* whose upper or free ends are fitted with resiliently deformable cushion elements 92*a* and 92*b* arranged to normally underengage upper brackets 84*a* and 84*b;* tension spring devices 94*a* and 94*b*, which are opposite end connected to upper brackets 84*a* and 84*b* and mounting brackets 74*a* and 74*b;* and slide supports 96*a* and 96*b*, which are of inverted, generally U-shaped cross-sectional design and tiltably connected to lower brackets 85*a* and 85*b* by suitable fasteners, such as bolts 98*a* and 98*b* passing vertically through disc shaped connectors 99*a* and 99*b* formed of a resiliently deformable material.

Figure 6:
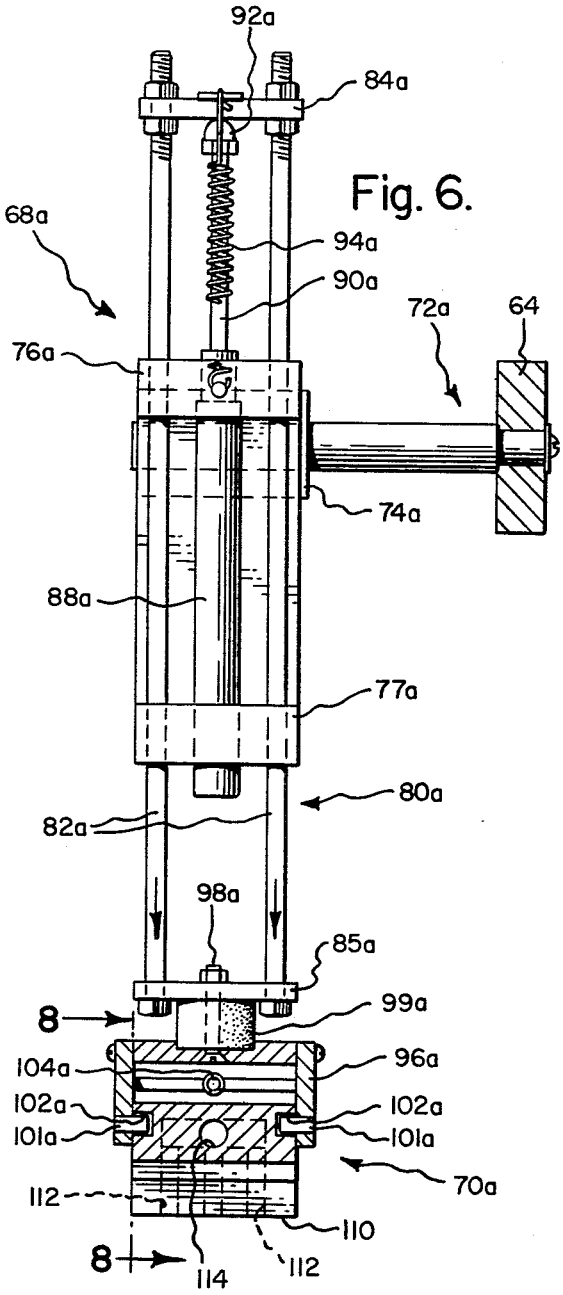
FIG. 6 is a sectional view taken generally along the line 6—6 in FIG. 1.
Figure 7:
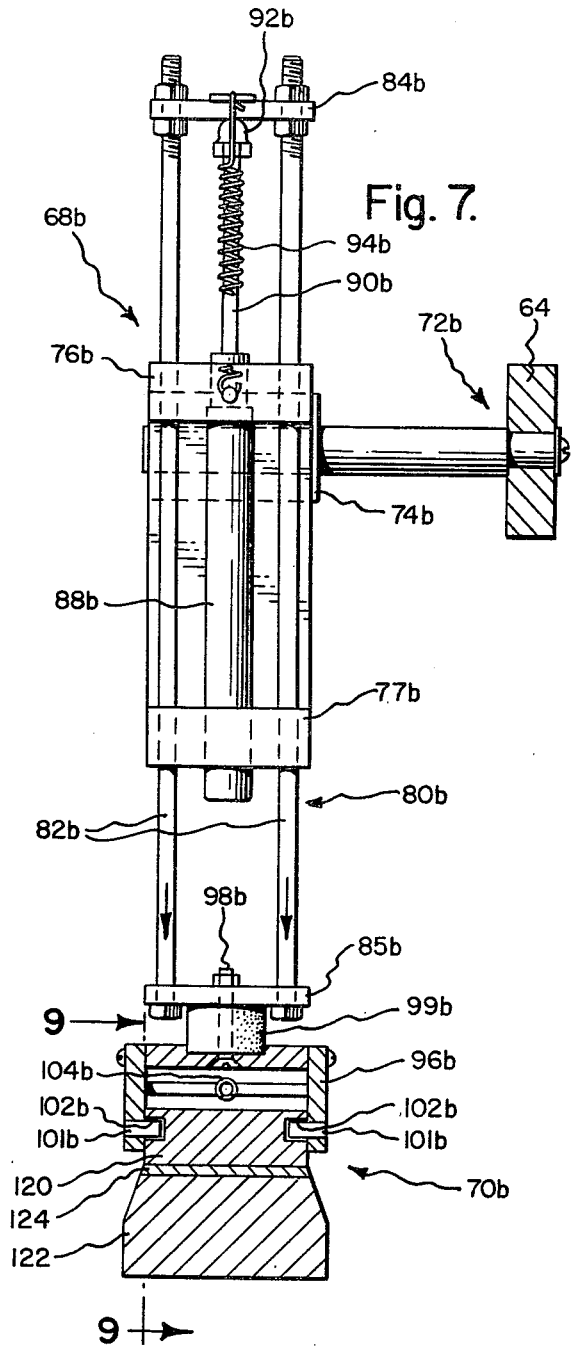
FIG. 7 is a sectional view taken generally along the line 7—7 in FIG. 1.

By viewing FIGS. 5, 6 and 7, it will be understood that operators 88*a* and 88*b* are normally operable to maintain piston rods 90*a* and 90*b* in an extended condition such that slide assemblies 80*a* and 80*b* and thus feet 70*a* and 70*b* are retained in an initial or vertical rest position against the bias of gravity and spring devices 94*a* and 94*b*. When piston rods 90*a* and 90*b* are retracted, spring devices 94*a* and 94*b* assist the force of gravity in driving the slide assemblies downwardly as indicated by the arrows in FIGS. 6 and 7, whereby to move feet 70*a* and 70*b* downwardly into their lower or operative vertical positions defined by engagement thereof with articles 14, as indicated in phantom line in FIG. 5. The extent of vertical displacement of feet 70*a* and 70*b* from their vertical rest positions will of course be determined by the vertical height of the articles to which the labels are to be applied.

Figure 8:
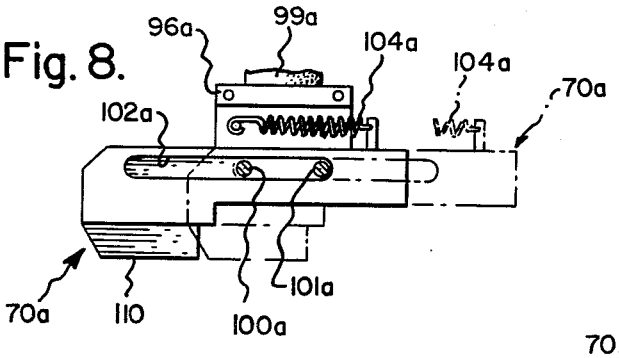
FIG. 8 is a sectional view taken generally along the line 8—8 in FIG. 6.
Figure 9:
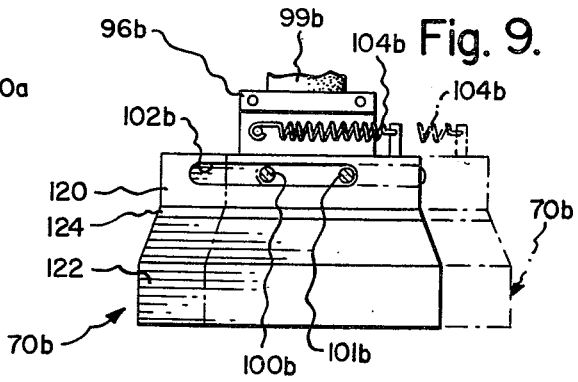
FIG. 9 is a sectional view taken generally along the line 9—9 in FIG. 7.

By referring to FIGS. 5, 8 and 9, it will be understood that feet 70*a* and 70*b* are also slidably supported by slide supports 96*a* and 96*b* for horizontally directed displacements in alignment with the direction of conveyor travel by means of slide support mounted guide pins 100*a*, 101*a* and 100*b*, 101*b* slidably received within elongated slots 102*a* and 102*b* defined by feet 70*a* and 70*b*. Further, relatively weak tension spring devices 104*a* and 104*b*, which are opposite end connected to the slide supports and the feet, normally serve to retain the feet in their initial or horizontal rest positions, such as may be defined by engagement of guide pins 101*a* and 101*b* with their adjacently disposed ends of slots 102*a* and 102*b*, as shown in full line in FIGS. 8 and 9 and generally indicated in full line in FIG. 5. Feet 70*a* and 70*b* may be displaced from their first or rest positions as indicated in phantom line in FIGS. 8 and 9 against the bias of springs 104*a* and 104*b* through a maximum distance limited by engagement of guide pins 100*a* and 100*b* with their adjacently disposed ends of slots 102*a* and 102*b*.

Now referring particularly to FIGS. 5, 6 and 8, it will be understood that label applicator 70*a* is shaped to define a generally horizontally disposed and essentially planar applicator surface 110 through which open a plurality of passageways 112 arranged in communication with a main passageway 114. Passageway 114 is in turn adapted to be selectively placed in communication with a source of vacuum, not shown, by means including a conduit or tube 116. In use, device 72*a*, bracket 84*a* and/or plate 40 are adjusted such that applicator foot 70*a* is arranged in its rest position shown in FIG. 5, wherein applicator surface 110 is arranged to engage and pick up the upper non-adhesive or printed surface of label 20 as the latter is fed from a source of labels defined in part by separator device 28. More specifically, applicator surface 110 would be normally arranged slightly above peeling edge 42 and spaced horizontally therefrom through a distance substantially less than the length of the label in the direction of conveyor travel in order to insure that a substantial portion of the fully peeled label is engaged by the applicator surface. It will be appreciated that the vacuum source would be adjusted to provide sufficient degree of vacuum to insure that label 20 is picked up and retained in engagement with applicator surface 110, while at the same time permitting sliding movements of the label lengthwise of such surface in the direction of conveyor travel, as the label is progressively peeled from carrier tape 22. Sliding movement of the label is facilitated by the inherent stiffness of the label when translated in a direction arranged essentially coplanar therewith and by providing an applicator surface 110 with a very smooth surface finish. Of course, sliding movement of the label lengthwise of applicator surface 110 will terminate as soon as the trailing edge of the label is separated from carrier tape 20 passing around peeling edge 42.

Compressor foot 70*b* is best shown in FIGS. 5, 7 and 9 as including a rigid slide portion 120, which defines slots 102*b*, and a resilient pressure portion 122, which is suitably fixed to depend from slide portion 120 as by a layer of flexible adhesive 124. Pressure portion 122 is characterized as being formed from a very soft and resiliently deformable foam or spongelike material enabling it to readily mold form its lower or pressure applying surface around the contoured or irregularly shaped upper surface of package 14 to which label 20 is to be applied.

In operation, the rates of travel of carrier tape 22 and conveyor 12 are suitably coordinated such that a properly printed label is presented for vacuum pickup by foot 70*a* in the manner previously described, when the latter is disposed in its initial vertical/horizontal rest position shown in FIG. 5 incident to the arrival of an article 14 at the labeling station; operation of applicator mechanism 18 being thereafter initiated, as by a suitable article presence sensor, such as an electric eye or proximity sensor 130. Sensor 130 initially serves to effect operation of operator 88*a* in order to retract piston rod 90*a* and thereby allow automatic lowering of foot 70*a*, thereby to force a printed label carried by surface 110 into "initial" adhesive bonding engagement with the upper surface of the sensed article. By again viewing FIG. 5, it will be understood that even when a label is applied to a flat surfaced article, its initial bond therewith normally not be uniform, since its trailing edge portion is not clamped against the article by applicator surface 110.

Preferably, the control circuit for applicator mechanism 18 includes a time delay device permitting a short period of time to elapse between retraction and subsequent extraction of piston rod 90*a* in order to allow applicator foot 70*a* to momentarily remain in its lower or operable position after application of label 20 to article 14. During this momentary delay in operation, applicator foot 70*a* is allowed to undergo conjunctive movements with the article in the direction of conveyor travel in response to frictional engagement of the applicator foot with the label and/or adjacent portions of the surface of the article.

Preferably, before foot 70*a* has been horizontally displaced sufficiently to result in engagement of guide in 100*a* with its associated end of guide slot 102*a*, the control circuit is operable to interrupt the vacuum condition in passageway 114, whereby to release the applied label from surface 110, and to extend piston rod 90*a* in order to return applicator foot 70*a* to its upper rest position. Upon upward movement of foot 70*a* from frictional constraining engagement with label and/or adjacently disposed portions of the article surface, spring device 104*a* is operable to return foot 70*a* to its rest horizontal position, whereupon the vacuum condition in passageway 114 is again established. Operation is such as to insure return of applicator foot 70*a* to its rest position shown in full line in FIGS. 1 and 5 prior to the arrival of the next or succeeding article at labeling station 10. The ability of applicator foot 70*a* to undergo conjunctive movements with the article after initial application of the label thereto affords sufficient time to interrupt the vacuum condition present within passageway 114 in order to insure separation of the label from applicator surface 110 without disturbing the initial bond between the label and the article; serves to prevent or minimize relative horizontal movements between the foot, the label and the article, such as might otherwise cause displacements of the label relative to the article and/or damage to the surface of the article; and serves to positively maintain the label in engagement with the article during a substantial portion of article travel between the point at which the label is initially applied and the point at which a compressor foot 70*b* becomes operative. This ability of applicator foot to undergo horizontal displacements is particularly advantageous in situations wherein the label is to be applied to a contoured or irregularly shaped article surface, which may prevent initial bonding of more than a very small portion of the label thereto and may have "higher" surface areas than the area to which the label is applied.

The controls for operator 88*b* are slaved to the controls for operator 88*a* in order to delay operation of the former until applicator foot 70*a* has been lifted from engagement with article 14 and such article has been moved by conveyor 12 into vertical alignment with compressor foot 70*a*, as indicated in phantom line in FIG. 5. When operator 88*b* is operated to retract piston rod 90*b*, compresor foot 70*b* is driven downwardly by means of gravity and spring device 94*b* into engagement with the applied label, whereby to cause "molding" of the label to assume the contour of the upper surface of the article and effect a uniform bond therebetween. The ability of compressor foot 70*b* to subsequently undergo conjunctive movements with the article in the direction of conveyor travel permits the bonding operation to be completed and the compressor foot subsequently lifted without damage to the label or the article.

Preferably, operator 88*b* is energized to extend piston rod 90*b* for the purpose of returning compressor foot 70*b* to its original upper rest position prior to engagement of guide pins 100*b* with the ends of guide slots 102*b*, whereupon spring device 104*b* is operable to return the compressor foot to its original horizontal rest position shown in FIGS. 1 and 5.

The above described sequence of events occurs each time an article is sensed by sensor 130.

While the above described mode of operation is preferred for the reasons already discussed, it would of course be possible to enlarge the horizontal spacing between feet 70*a* and 70*b*, such as to permit operators 88*a* and 88*b* to be operated so as to simultaneously drive the feet into engagement with a pair of adjacently disposed packages.

For situations requiring extremely accurate positioning of labels on the articles, conveyor 12 may be provided with a vertically extensible stop 140 adapted to momentarily arrest article travel beneath applicator foot 70*a*. The operator for controlling stop 140 may be conveniently controlled as by sensor 130. When stop 140 is employed, applicator foot 70*a* would normally only be subjected to vertical reciprocating movements.

It will be understood that means other than gravity and/or spring force may be employed to drive feet 70*a* and 70*b* into operative engagement with the transported articles, thus permitting labels to be applied to such articles while being transported along a path of travel other than horizontal.

I claim:

1. An apparatus for applying labels to articles, which comprises:

a conveyor for transporting said articles in succession along a path of travel;

a source of labels spaced from said conveyor;

label applicator means having an applicator foot mounted for reciprocating movements transversely of said path of travel between said source and said conveyor for picking up labels from said source and moving said labels into label applying engagement with a surface of an article transported by said conveyor, and for conjunctive movement with an article in alignment with said path of travel as an incident to application of said label to said surface thereof; and label compression means arranged relatively downstream of said label applicator means along said path of travel and including a compressor foot mounted for reciprocating movements transversely of said path of travel for removably applying pressure to an article surface applied label for mold forming same to assume the contour of the surface of an article to which it is applied, and for conjunctive movement with such article in alignment with said path of travel as an incident to pressure mold forming of said label applied thereto.

2. An apparatus for applying labels to articles, which comprises:

a conveyor for transporting said articles in succession along an essentially horizontal path of travel;

a source of labels spaced from said conveyor;

label applicator means having an applicator foot mounted for reciprocating movements transversely of said path of travel between said source and said conveyor for picking up labels from said source and moving said labels into label applying engagement with a surface of an article transported by said conveyor; and label compression means arranged relatively downstream of said label applicator means along said path of travel and including a compressor foot, a supporting assembly having a stationary mounting bracket disposed above said conveyor, a slide assembly carried by said mounting bracket for vertically directed reciprocating movements towards and away from said conveyor, a support carried by said slide assembly adjacent a lower end thereof for mounting said compressor foot, and means for effecting vertical reciprocating movements of said slide assembly whereby to move said compressor foot transversely of said path of travel between an upper rest position and a lower operative position for removably applying pressure to an article surface applied label for mold forming same to assume the contour of the surface of an article to which it is applied, said compressor foot being slidably carried by said support for horizontal reciprocating movements in the direction of said path of travel and spring means are provided to normally retain said compressor foot in a horizontal rest position disposed in vertical alignment with said upper rest position, said spring means being deformable to permit conjunctive movement of said compressor foot with said article in the direction of said path of travel while in mold forming engagement with a label applied thereto.

3. An apparatus according to claim 2, wherein said means for effecting vertical reciprocating movements includes a spring engaged with said mounting bracket and slide assembly and tending to assist gravity in driving said compressor foot from said upper rest position downwardly into said operating position; and an operator having a vertically disposed piston rod, said operator being operable to extend said piston rod into underengagement with said slide assembly, whereby to lift said compressor foot into said upper rest position against the bias of gravity and said spring and to retract said piston rod to free said slide assembly for movement under the control of said bias to force said compressor foot into said operative position.

4. An apparatus for applying labels to articles, which comprises:

a conveyor for transporting said articles in succession along an essentially horizontal path of travel;

a source of labels spaced from said conveyor;

label applicator means having an applicator foot, said applicator foot having an essentially horizontally disposed and downwardly facing applicator surface having passageways opening therethrough for selectively placing said applicator surface in flow communication with a source of vacuum, whereby to enable said applicator foot to releasably pick up a label engaged with said applicator surface, a supporting assembly having a stationary mounting bracket disposed above said conveyor, a slide assembly carried by said mounting bracket for vertical reciprocating movement towards and away from said conveyor, a support carried by said slide assembly adjacent a lower end thereof for mounting said applicator foot, and means for effecting vertical reciprocating movements of said slide assembly whereby to move said applicator foot between an upper rest position in which it is arranged to pick up said labels from said source and a lower operative position in which it is arranged to apply said labels to said articles, said source of labels being operable to feed one label at a time into sliding engagement with said applicator surface, while said applicator foot is in said upper rest position, said applicator foot being slidably carried by said support for horizontal reciprocating movement in the direction of said path of travel and spring means is provided for normally retaining said applicator foot in a horizontal rest position disposed in vertical alignment with said upper rest portion, said spring means being deformable to permit conjunctive movement of said applicator foot with said article in the direction of conveyor travel while in label applying engagement therewith; and label compression means arranged relatively downstream of said label applicator means along said path of travel and including a compressor foot mounted for reciprocating movements transversely of said path of travel for removably applying pressure to an article surface applied label for mold forming same to assume the contour of the surface of an article to which it is applied, and for conjunctive movement with such article in alignment with said path of travel as an incident to pressure mold forming of said label applied thereto.

5. An apparatus for applying labels to articles, which comprises:

a conveyor for transporting said articles in succession along an essentially horizontal path of travel;

a source of labels spaced from said conveyor;

label applicator means having an applicator foot mounted for reciprocating movements transversely of said path of travel between said source and said conveyor for picking up labels from said source and moving said labels into label applying engagement with a surface of an article transported by said conveyor, and for conjunctive movement with such article in alignment with said path of travel as an incident to application of said label to said surface thereof; and label compression means arranged relatively downstream of said label applicator means along said path of travel and including a compressor foot mounted for reciprocating movements transversely of said path of travel for removably applying pressure to an article surface applied label for mold forming same to assume the contour of the surface of an article to which it is applied, and for conjunctive movement with such article in alignment with said path of travel as an incident to pressure mold forming of said label applied thereto, each of said label applicator means and said label compression means includes a supporting assembly having a stationary mounting bracket disposed above said conveyor, a slide assembly carried by said mounting bracket for vertically directed reciprocating movements towards and away from said conveyor, a support carried by said slide assembly adjacent a lower end thereof for mounting an associated one of said applicator and compressor feet, and means for effecting vertical reciprocating movements of said slide assembly whereby to move its associated one of said applicator and compressor feet between upper rest positions and lower operative positions, said applicator foot when in said upper rest position thereof being arranged to pick up said labels from said source, each said support supporting its associated one of said applicator and compressor feet for horizontally directed reciprocating movements in the direction of said path of travel and being connected to its associated one of said applicator and compressor feet by spring means normally tending to retain its associated one of said applicator and compressor feet in a horizontal rest position disposed in vertical alignment with said upper rest position thereof, said spring means being deformable to permit conjunctive movement of its associated one of said applicator and compressor feet with said article in the direction of said path of travel while in engagement therewith.

6. An apparatus according to claim 5, wherein said applicator foot defines an essentially horizontally disposed and downwardly facing applicator surface having passageways opening therethrough for selectively placing said applicator surface in flow communication with a source of vacuum, whereby to enable said applicator foot to releasably pick up a label engaged with said applicator surface; and wherein said source of labels includes a supply of labels each having a non-adhesive surface to which article identifying indicia may be applied and pressure sensitive adhesive surface by which said label may be temporarily bonded to a carrier tape; a plate defining an essentially horizontally disposed peeling edge, and means to pass said carrier tape about said peeling edge whereby to effect peeling of said labels one at a time therefrom, said peeling edge being arranged in essential alignment with said applicator surface in the direction of conveyor travel whereby said non-adhesive surface of a label is directed into sliding engagement with said applicator surface incident to the peeling of such label from said carrier tape and said pressure sensitive adhesive surface is arranged to engage with said surface of an article when said applicator foot is subsequently moved into said operative position thereof.

7. An apparatus according to claim 6, wherein said plate is supported for pivotal adjustments about a horizontally disposed axis extending transversely of said path of travel and for adjustment in a direction aligned with said path of travel, and means are provided to adjustably locate the position of each said mounting bracket along said path of travel.

8. An apparatus for applying labels to articles, which comprises:

a conveyor for transporting said articles in succession along an essentially horizontally disposed path of travel;

a source of labels spaced from said conveyor;

label applicator means having an applicator foot and means for mounting said applicator foot for movements transversely of said path of travel between a rest position in which it is arranged to pick up a label from said source and an operative position in which it is arranged to place said label in engagement with a surface of an article transported by said conveyor; and label compression means arranged relatively downstream of said label applicator means along said path of travel, said label compression means including a compressor foot and means for mounting said compressor foot for movements transversely of said path of travel between a rest position and an operative position for removably applying pressure to an article surface applied label for mold forming same to assume the contour of the surface of an article to which it is applied and for horizontal movements in the direction of said path of travel, said means for mounting said compressor foot including spring means tending to normally retain said compressor foot in a horizontal position disposed in vertical alignment with said rest position thereof, and said spring means being deformable to permit conjunctive movement of said compressor foot with said article away from said horizontal position thereof in the direction of said path of travel as an incident to pressure mold forming of said article surface applied label.

9. An apparatus according to claim 8, wherein said means for mounting said applicator foot includes means for supporting said applicator foot for conjunctive movement with an article in alignment with said path of travel as an incident to application of said label to said surface thereof.

10. An apparatus according to claim 8, wherein said means for mounting said applicator foot includes means for supporting said applicator foot for horizontal movements in the direction of said path of travel and spring means tending to normally retain said applicator foot in a horizontal position disposed in vertical alignment with said rest position thereof, and the last said spring means being deformable to permit conjunctive movement of said applicator foot with said article away from said horizontal position thereof in the direction of said path of travel as an incident to application of said label to said surface thereof.

11. An apparatus for applying labels to articles, which comprises:

a conveyor for transporting said articles in succession along an essentially horizontal path of travel; a source of labels disposed in spaced relationship vertically above said conveyor;

a bracket assembly disposed in spaced relationship vertically above said conveyor;

label applicator means suspended from said bracket assembly and operable to pick up labels from said source and move such labels into label applying engagement with a surface of an article transported by said conveyor;

label compressor means arranged relatively downstream of said label applicator means along said path of travel, said compressor means including a compressor foot, a support for mounting said compressor foot and means for suspending said support from said bracket assembly and effecting vertically directed reciprocating movements thereof whereby to move said compressor foot between an upper rest position in which it is spaced from said articles transported by said conveyor and a lower operative position in which it is arranged for mold forming engagement with an article surface applied label for mold forming same to assume the contour of such article surface to which it is applied, said support additionally slidably mounting said compressor foot for horizontally directed reciprocating movements relative thereto in alignment with said path of travel from a horizontal position disposed in vertical alignment with said upper rest position thereof into another horizontal position arranged relatively downstream of said horizontal position in the direction of said path of travel as an incident to movement of said article while said compressor foot is in mold forming engagement with said article surface applied label, and a spring device for interconnecting said support and said compressor foot and operable to return said compressor foot to said horizontal position incident to movement of said compressor foor between said operative and rest positions.

12. An apparatus for applying labels to articles including a conveyor for transporting said articles in succession along an essentially horizontal path of travel; a source of labels disposed in spaced relationship vertically above said conveyor; a bracket assembly disposed in spaced relationship vertically above said conveyor; label applicator means suspended from said bracket assembly and operable to pick up labels from said source and move such labels into label applying engagement with a surface of an article transported by said conveyor, said applicator means including an applicator foot operable to pick up and apply said labels, a support for mounting said applicator foot, and means for suspending said support from said bracket assembly and effecting vertically directed reciprocating movements thereof whereby to move said applicator foot between an upper rest position in which said applicator foot is arranged to pick up labels from said source and a lower operative position in which said applicator foot is arranged to apply labels to said articles, said support slidably mounting said applicator foot for horizontally directed reciprocating movements relative thereto in alignment with said path of travel from a horizontal position disposed in vertical alignment with said upper rest position thereof into another horizontal position arranged relatively downstream of the last said horizontal position in the direction of said path of travel as an incident to movement of said article while said applicator foot is in label applying engagement therewith, and means interconnecting said support and said applicator foot and operable to return said applicator foot to said last said horizontal position incident to movement of said applicator foot between said operative and rest positions thereof; label compressor means arranged relatively downstream of said label applicator means along said path of travel, said compressor means including a compressor foot, a support for mounting said compressor foot and means for suspending the last said support from said bracket assembly and effecting vertically directed reciprocating movements thereof whereby to move said compressor foot between an upper rest position in which it is spaced from said articles transported by said conveyor and a lower operative position in which it is arranged for mold forming engagement with an article surface applied label for mold forming same to assume the contour of such article surface to which it is applied, the last said support additionally slidably mounting said compressor foot for horizontally directed reciprocating movements relative thereto in alignment with said path of travel from a horizontal position disposed in vertical alignment with said upper rest position thereof into another horizontal position arranged relatively downstream of said horizontal position in the direction of said path of travel as an incident to movement of said article while said compressor foot is in mold forming engagement with said article surface applied label, and means interconnecting the last said support and said compressor foot and operable to return said compressor foot to said horizontal position incident to movement of said compressor foot between said operative and rest positions, wherein said means interconnecting said support and the last said support to said applicator foot and said compressor foot, respectively, are spring devices; and said bracket assembly includes a fixed part and a movable part for mounting said label applicator means and said label compressor means, said movable part being hinged to said fixed part for movement about a vertically extending hinge axis for removably positioning said applicator foot and said compressor foot in vertical alignment with said conveyor, and said label applicator means and said label compressor means being fixed to said movable part for horizontally directed adjustments lengthwise thereof whereby to selectively vary the distance between said applicator foot when in said upper rest position thereof and said source and between said applicator foot and said compressor foot when in said upper rest positions thereof in a direction aligned with said path of travel.

* * * * *

UNITED STATES PATENT AND TRADEMARK OFFICE

CERTIFICATE OF CORRECTION

PATENT NO. : 4,025,382

DATED : May 24, 1977

INVENTOR(S) : Victor Del Rosso

It is certified that error appears in the above-identified patent and that said Letters Patent are hereby corrected as shown below:

Col. 2, Line 47 - "face" should be --- fact ---.

Col. 2, Line 48 - "type" should be --- tape ---.

Col. 2, Line 58 - "carriage" should be --- carrier ---.

Col. 5, Line 26 - After "therewith" insert --- will ---.

Col. 5, Line 43 - "in" should be --- pin ---.

Col. 11, Line 34 - "foor" should be --- foot ---.

Signed and Sealed this

*Twentieth* Day of *September 1977*

[SEAL]

*Attest:*

RUTH C. MASON
*Attesting Officer*

LUTRELLE F. PARKER
*Acting Commissioner of Patents and Trademarks*